US007640772B2

(12) United States Patent
Johnson

(10) Patent No.: US 7,640,772 B2
(45) Date of Patent: Jan. 5, 2010

(54) WATERSPORTS APPARATUS LOCKING DEVICE

(76) Inventor: James Johnson, 1880 Ocean St., Oceano, CA (US) 93445

( * ) Notice: Subject to any disclaimer, the term of this patent is extended or adjusted under 35 U.S.C. 154(b) by 362 days.

(21) Appl. No.: 11/747,896

(22) Filed: May 12, 2007

(65) Prior Publication Data

US 2007/0271971 A1 Nov. 29, 2007

Related U.S. Application Data

(60) Provisional application No. 60/803,119, filed on May 24, 2006.

(51) Int. Cl.
*E05B 73/00* (2006.01)

(52) U.S. Cl. ..... 70/2; 70/14; 70/18; 70/58; 7/158; 114/172; 292/281; 441/74; 441/75

(58) Field of Classification Search ..... 70/2, 70/14, 18, 19, 58, 232, DIG. 30, DIG. 57, 70/DIG. 63; 7/151, 158, 165; 24/265 H, 24/265 EC, 265 CD; 292/281–286; 441/74, 441/75; 114/172
See application file for complete search history.

(56) References Cited

U.S. PATENT DOCUMENTS

| | | | | | |
|---|---|---|---|---|---|
| 716,118 | A | * | 12/1902 | Scott | 292/1 |
| 1,383,781 | A | * | 7/1921 | Ball | 200/43.14 |
| 1,623,050 | A | * | 4/1927 | Frantz | 292/281 |
| 2,560,624 | A | * | 7/1951 | Bartlett | 70/14 |
| 3,312,794 | A | * | 4/1967 | Hollyday | 200/43.15 |
| 3,667,259 | A | * | 6/1972 | Reque et al. | 70/14 |
| 4,674,306 | A | * | 6/1987 | Halpern | 70/233 |
| 4,680,949 | A | | 7/1987 | Stewart | |
| 4,745,783 | A | * | 5/1988 | Poe | 70/2 |
| 4,896,519 | A | | 1/1990 | Pitts | |
| 4,938,040 | A | * | 7/1990 | Humphreys, Jr. | 70/58 |
| 5,119,649 | A | | 6/1992 | Spence | |
| 5,127,861 | A | | 7/1992 | Ross | |
| 5,167,135 | A | * | 12/1992 | Gobeski | 70/14 |
| 5,349,145 | A | * | 9/1994 | Kelaita et al. | 200/43.15 |
| 5,467,622 | A | * | 11/1995 | Becker et al. | 70/203 |
| 5,582,044 | A | | 12/1996 | Bolich | |
| 5,706,680 | A | | 1/1998 | Wroble | |
| 5,934,113 | A | * | 8/1999 | Loughlin | 70/50 |
| 6,082,154 | A | | 7/2000 | MacDonald | |
| 6,321,579 | B1 | * | 11/2001 | Reyes | 70/58 |

(Continued)

FOREIGN PATENT DOCUMENTS

| | | |
|---|---|---|
| WO | WO0160660 A1 | 8/2001 |

(Continued)

*Primary Examiner*—Lloyd A Gall
(74) *Attorney, Agent, or Firm*—Philip A. Steiner

(57) ABSTRACT

A locking device for a watersports apparatus which in one embodiment, comprises a pair of interlocking brackets which form an inverted "T" when slidably disposed in a channel associated with a fin box. Apertures are provided to allow a cable or other security device to traverse the inverted "T" locking device for securing the watersports apparatus. In a second embodiment, a pair of generally planar scissor members having a pair of unguiform clasping elements aligned in opposition and configured to clasp a rod disposed in a tether plug aperture by scissor action. Useful watersport tools may be provided on the distal ends of the generally planar scissor members. The useful tools include a screwdriver, a wax comb, a bottle cap opener and a wax scrapper.

8 Claims, 8 Drawing Sheets

U.S. PATENT DOCUMENTS

| | | | | |
|---|---|---|---|---|
| D481,614 | S | 11/2003 | Onel | |
| 6,688,145 | B2 | 2/2004 | Tan | |
| 6,691,537 | B2 | 2/2004 | Tan | |
| D488,368 | S | 4/2004 | Vito | |
| 7,089,619 | B2 * | 8/2006 | Smith | 7/128 |
| 7,152,440 | B1 * | 12/2006 | Austin | 70/58 |
| 7,294,032 | B1 * | 11/2007 | Ventura | 441/75 |
| 2003/0089141 | A1 * | 5/2003 | Edwards et al. | 70/18 |
| 2005/0278866 | A1 * | 12/2005 | Madarieta | 7/120 |
| 2006/0032275 | A1 | 2/2006 | Hooks | |
| 2008/0141464 | A1 * | 6/2008 | Pikielny | 7/118 |

FOREIGN PATENT DOCUMENTS

| | | | |
|---|---|---|---|
| WO | WO03042476 | A1 | 5/2003 |

* cited by examiner

WATERSPORTS APPARATUS LOCKING DEVICE

CROSS-REFERENCE TO RELATED APPLICATIONS

This application claims benefit and priority under 35 U.S.C. §119(e) from U.S. provisional patent application Ser. No. 60/803,119 filed May 24, 2006 to the instant inventor; said provisional application is hereby incorporated by reference as if fully set forth herein.

FEDERALLY SPONSORED RESEARCH AND DEVELOPMENT

Not Applicable

REFERENCE TO A MICROFICHE APPENDIX

Not Applicable

RELEVENT INVENTIVE FIELD

The various exemplary embodiments disclosed herein relate generally to a portable security device, and more specifically to a palm sized locking device for a watersports apparatus.

BACKGROUND

The use of watersports apparatus, for example; surfboard, boogie boards, skim boards and wake boards have become increasingly popular for recreational usage. Many of the watersports apparatus, particularly surfboards, have become expensive and subject to thief if left unattended or unsecured.

However, the ability to secure watersports apparatus is limited due to the lack of attachment surfaces available. Moreover, the addition of attachment surfaces requires expensive customization and may interfere with the "feel" of the board during use or otherwise introduces protuberances and/or depressions which both hinder the use of the board and adds cosmetically undesirable visual features.

In general, most of the improvements in the relevant art, have been directed toward locking racks which are used for transporting the watersports apparatus by motor vehicle to a location for use. However, few simple devices are available to secure the watersports apparatus when in a location for use and do not require modification of the watersports apparatus for attaching a locking device. Therefore, a watersports apparatus locking device which is highly portable and does not require modifications for use is highly desirable in the relevant art.

SUMMARY

In various exemplary embodiments, locking devices for watersports apparatus are disclosed which allow a watersports enthusiast to secure his or her boards while left unattended. In a first exemplary embodiment shown in FIGS. 1A-1D and 2A-2D, a locking device for a watersports apparatus is provided. In this first exemplary embodiment, the locking device is comprised of two interlocking brackets 5, 35 which are dimensioned to fit within a fin slot of a watersports apparatus. The first interlocking bracket 5 comprises a first generally planar element, a generally centralized first aperture 20, a first anterior edge 30, a first posterior edge 22, a first base edge 12, a lateral support element 10 projecting perpendicularly from the first base edge 12, a top edge 27 including a generally downward facing channel element 25 which parallels the lateral support element 10, a first slot 15 disposed superjacent and generally in parallel to the first base edge 12 and extending a partial distance toward the first anterior edge 30 of the bracket.

The second interlocking bracket 35 comprises a second generally planar element, a generally centralized second aperture 40, a second anterior edge 37, a second posterior edge 39, a second base edge 47, a contra-lateral support element 45 projecting perpendicularly from the second base edge 47, a top edge 41 dimensioned to slidably fit within the channel element 25, a second slot 50 disposed superjacent and generally in parallel to the second base edge 47 and dimensioned to intercalate with the first slot 15 such that the first and second planar elements form an inverted "T" bracket. When so configured, the first 20 and the second apertures 40 are substantially aligned to provide a contiguous aperture through the first and second interlocking brackets 5, 35. The contiguous aperture 20, 40 is dimensioned to receive at least a portion of a security device such as a cable therethrough which can be secured to another structure. The security device includes one of a cable, a chain, a padlock, a combination lock and any combination thereof effective to thwart misappropriation of a watersports apparatus.

In another related embodiment, the first and the second generally planar elements are dimensioned to separately fit into the fin slot associated with a watersports apparatus and slidably combine into the inverted "T" bracket. The inverted "T" bracket may remain in the fin slot during use of the watersports apparatus. While in use, a keeper device may be used to prevent the first and second planar elements from separating and being lost.

In yet another related embodiment, the keeper device comprises a first streamlined member having a threaded aperture; a second streamlined member having a bolt longitudinally aligned and compatible with the threaded aperture.

In a second exemplary embodiment, a locking device for a watersports apparatus is provided. The locking device comprises a first scissor member including; a first unguiform clasping member disposed at one longitudinal end, a first aperture disposed axially therethrough, a second scissor member including; a second unguiform clasping member disposed at one longitudinal end and generally aligned in opposition relative to the first unguiform clasping member; a second aperture axially disposed therethrough and axially alignable with the first aperture when the second scissor member is positioned generally in parallel relative to the first scissor member; and a fastener axially disposed through the first and the second scissor members forming a common longitudinal pivot point. The first and the second apertures are dimensioned to receive at least a portion of a locking device therethrough when in general axial alignment.

In a related embodiment, the first and the second unguiform clasping elements are configured to clasp a transversely aligned rod disposed in a recessed aperture. In another related embodiment, the first and second unguiform clasping elements are configured as hooks which clasp the rod from opposite sides.

In another related embodiment, a third scissor member is provided and aligned in parallel to the first and second generally scissor members and pivotal about a common axis provided by a generally centrally aligned fastener which perpendicularly traverses the first, second and third clasping members.

In another related embodiment, at least one of the first or second scissor members includes a comb, bottle opener or screwdriver disposed at a distal end from the first or the second unguiform clasping members.

In yet another related embodiment, the first and second unguiform clasping elements clasp the rod in a scissor-like action disposed in a recessed aperture associated with the watersports apparatus.

In a third exemplary embodiment, a combination locking device and multifunction tool for a watersports apparatus is provided. The combination locking device comprises a palm-sized locking device including; a pair of unguiform clasping elements aligned in opposition and configured to clasp by a scissor action, a rod disposed in a recessed aperture. The pair of unguiform clasping elements being disposed at one end of the palm-sized locking device and a plurality of tools disposed at a distal end of the palm-sized locking device relative to the pair of unguiform clasping members; and an axially disposed aperture in the palm-sized locking device dimensioned to receive at least a portion of a locking device therethrough.

In a related embodiment, at least one of a plurality of tools is one of; a bottle cap opener, a screwdriver; a wax comb and a wax scrapper.

In another related embodiment, the scissor action comprises at least a pair of generally planar handles are pivotally coupled together by a transversely disposed fastener in the palm-sized locking device.

In another related embodiment, the recessed aperture comprises a leash plug disposed in the watersports apparatus. In various related embodiments, the watersports apparatus is one of; a surfboard, a boogie board, a wake board and skim board.

BRIEF DESCRIPTION OF DRAWINGS

The various exemplary embodiments provide mechanisms for securely maintaining watersports boards. The features and advantages of the various inventive embodiments will become apparent from the following detailed description when considered in conjunction with the accompanying drawings. Where possible, the same reference numerals and characters are used to denote like features, elements, components or portions of the invention.

Optional or existing structural elements are generally shown in dashed lines. It is intended that changes and modifications can be made to the described exemplary embodiments without departing from the true inventive scope and spirit as defined by the claims.

DETAILED DESCRIPTION

Figure 1:
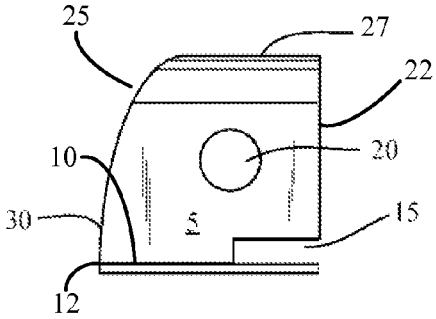
FIG. 1—depicts an exemplary side view of a first bracket used in an embodiment of a locking device.
Figure 1A:
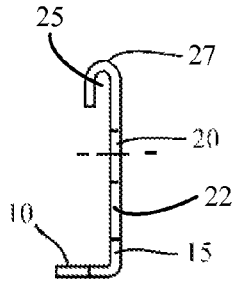
FIG. 1A—depicts an exemplary end view of the first bracket used in an embodiment of a locking device.
Figure 1B:
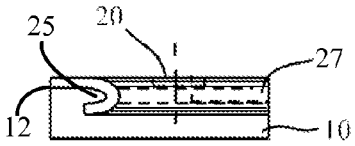
FIG. 1B—depicts an exemplary top view of the first bracket used in an embodiment of a locking device.
Figure 1C:
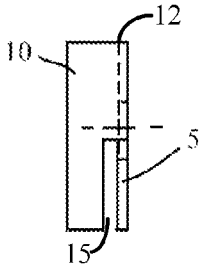
FIG. 1C—depicts an exemplary bottom view of the first bracket used in an embodiment of a locking device.

The various exemplary embodiments address the limitations in the relevant art for securing watersports apparatus while away from a motor vehicle. In a first exemplary locking device embodiment, a pair of interlocking brackets is provided. In FIGS. 1, 1A, 1B, 1C a first bracket 5 includes an inverted U-shaped channel 25 disposed on top of the bracket 5. The inverted U-shaped channel 25 is disposed in opposition to a lateral base 10 and dimensioned to receive the main body of a second bracket 35 (FIG. 2.) The first bracket 5 includes a first notch 15 cut into the posterior portion of the first bracket 5. The first notch 15 is disposed in superjacent to the first lateral base 10 and extends laterally towards the anterior edge 30 of the first bracket 5. In an embodiment, the anterior edge 30 includes a concave or parabolic profile to provide a more streamlined cross section when in use. A first aperture 20 is transversely provided through the face of the bracket 5. The first aperture 20 is dimensioned to receive a cable or shank of a padlock to secure the watersports apparatus to another structure.

In FIGS. 2, 2A, 2B, 2C, the second bracket 35 includes a lateral base 45 and is dimensioned to be slidably positioned between the curved channel 25 and lateral base 10 of the first bracket 5. A second notch 50 is provided in the second bracket 35. The second notch 50 is intended to be complementary to the first notch 15 which allows the first bracket 5 and the second bracket 35 to slidably interlock.

A second aperture 40 is provided through the face of the second bracket 35. The first and second apertures 20, 40 are axially aligned when the first bracket 5 and the second bracket 35 are interlocked together. The brackets 5, 35 may be cut from corrosive resistant metal sheet such as stainless steel stock or injection molded from a high impact plastic.

Figure 2E:
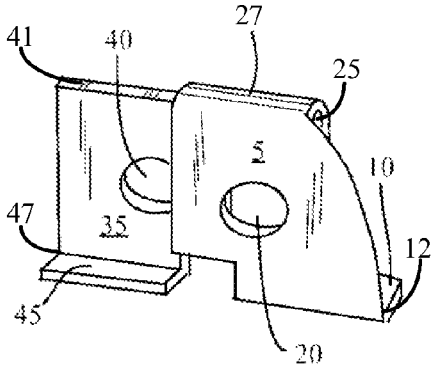
FIG. 2E—depicts an exemplary perspective view of the slidably interlocking first and second brackets used in an embodiment of a locking device.
Figure 2:
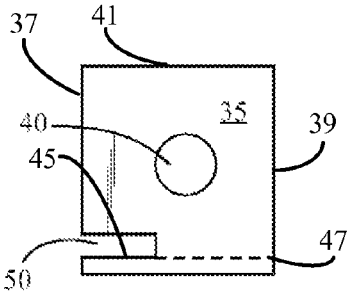
FIG. 2—depicts an exemplary side view of a second bracket used in an embodiment of a locking device.
Figure 2A:
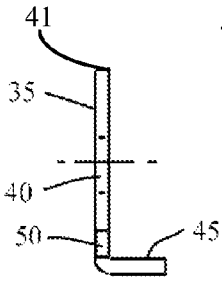
FIG. 2A—depicts an exemplary end view of the second bracket used in an embodiment of a locking device.
Figure 2B:
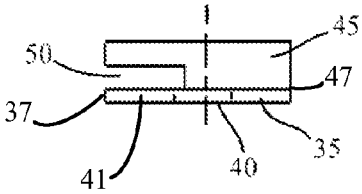
FIG. 2B—depicts an exemplary top view of the second bracket used in an embodiment of a locking device.
Figure 2C:
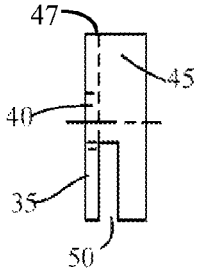
FIG. 2C—depicts an exemplary bottom view of the second bracket used in an embodiment of a locking device.
Figure 2D:
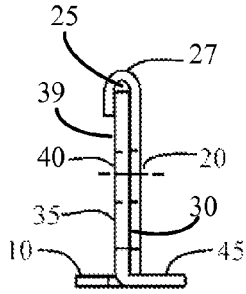
FIG. 2D—depicts an exemplary end view of the interlocked first and second brackets used in an embodiment of a locking device.

Referring to FIG. 2D, an end view is provided where the first and second brackets 5, 35 have been interlocked forming an inverted "T" locking device.

Referring to FIG. 2E, a perspective view is provided where the first and second brackets 5, 35 are slidably interlocked to form the inverted "T" locking device.

Figure 3:
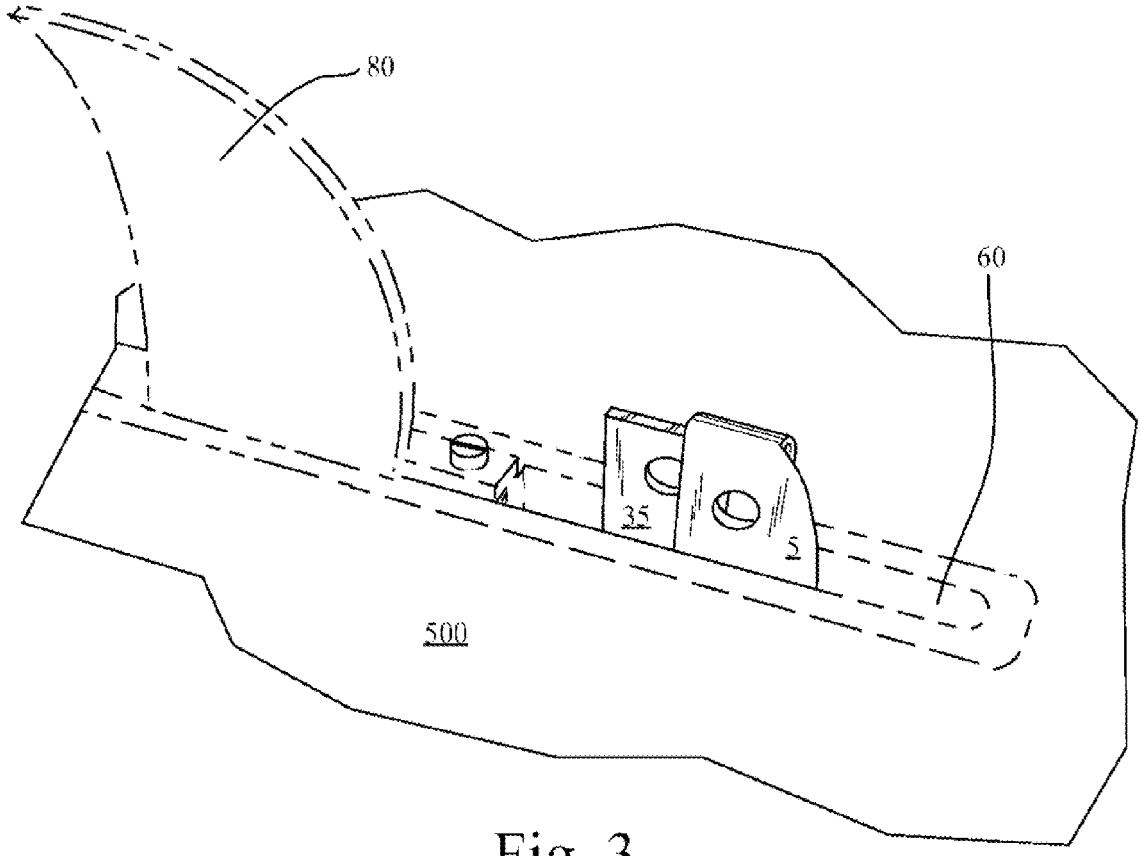
FIG. 3—depicts an exemplary perspective view of the slidably interlocking first and second brackets disposed in a fin box.

Referring to FIG. 3, a perspective view is provided which illustrates the relative positions and dimensions of the first and second brackets 5, 35 when installed in a fin box 60. The first and second brackets 5, 35 are installed in front of the fin 80 and may remain in place during use of the watersports apparatus 500.

Figure 3A:
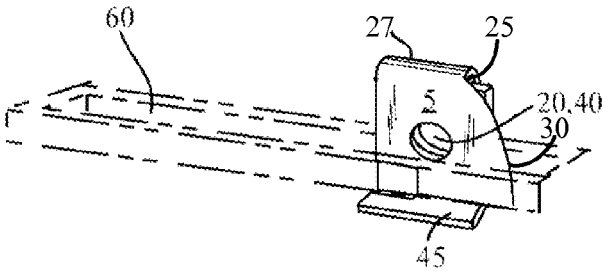
FIG. 3A—depicts an exemplary perspective cutaway view of the slidably interlocking first and second brackets disposed in a fin box.

Referring to FIG. 3A, a cutaway perspective view is provided which illustrates the lateral base 10, 45 of the second brackets 5, 35 being maintained within the structural channel associated with the fin box 60.

Figure 3B:
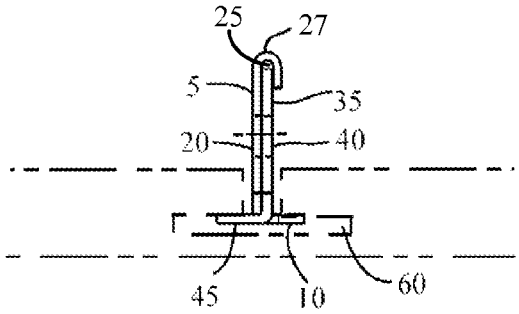
FIG. 3B—depicts an exemplary cross sectional cutaway view of the slidably interlocking first and second brackets disposed in a fin box.

Referring to FIG. 3B, a cutaway cross sectional view is provided which illustrates the interlocked first and second brackets 5, 35 forming the inverted "T" locking device. The lateral bases 10, 45 are dimensioned to span the lateral dimensions of the fin box 60 associated with a watersports apparatus 500.

Figure 4:
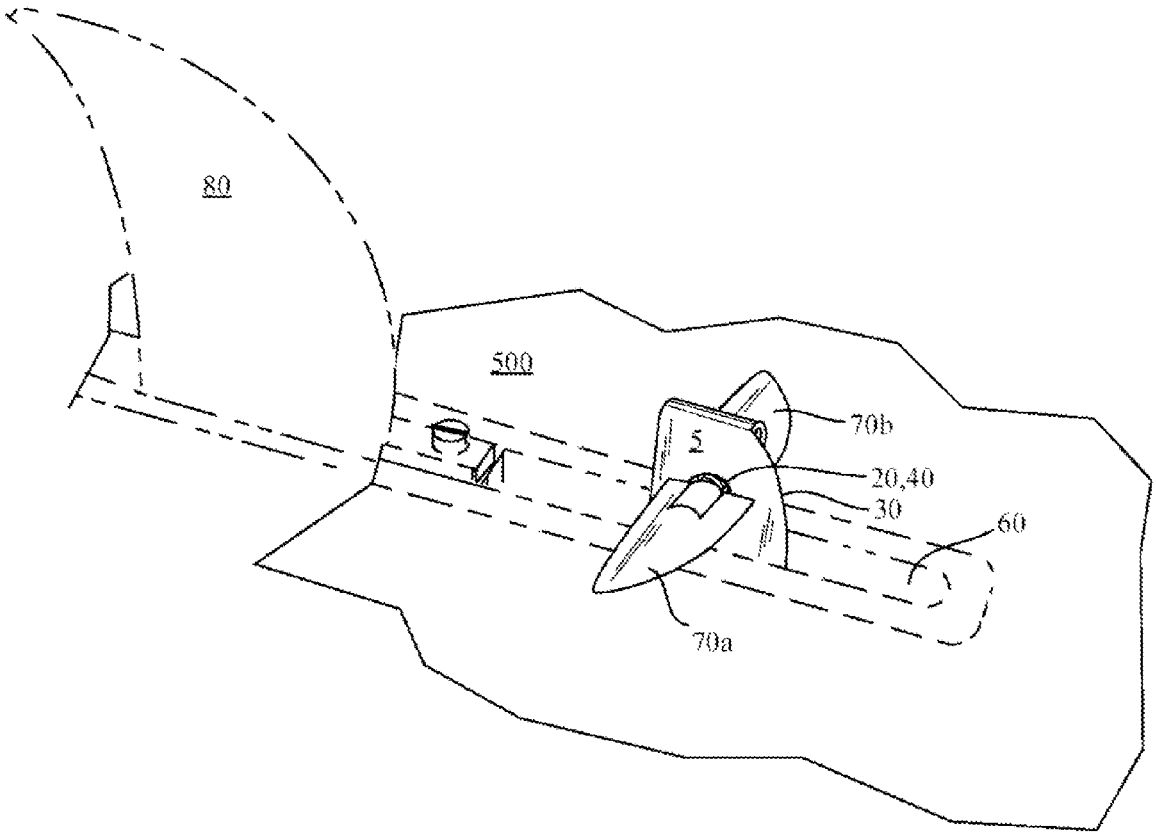
FIG. 4—depicts an exemplary perspective view of a keeper installed in an aperture of the locking device.
Figure 4A:
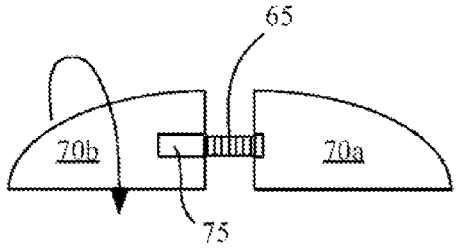
FIG. 4A—depicts an exemplary top view of the keeper used in an embodiment of the locking device.

Referring to FIG. 4, a keeper assembly 70A, 70B is provided to maintain the first and second brackets 5, 35 in place within the fin box 60 during use. In an embodiment, (FIG. 4A) the keeper assembly 70A, 70B is comprised of two half wing assemblies 70A, 70B. One of the half wings 70A includes a longitudinally aligned bolt 65. The length of the bolt 65 is dimensioned to span the width of the apertures 20, 40 and thread into a nut 75 installed in the second half wing 70B. The assembled keeper 70A, 70B is transversely aligned relative to the fin 80. The curved anterior 30 edge of the first bracket 5 and the streamlined winged shape of the keeper 70A, 70B are intended to reduce drag during use.

Figure 5:
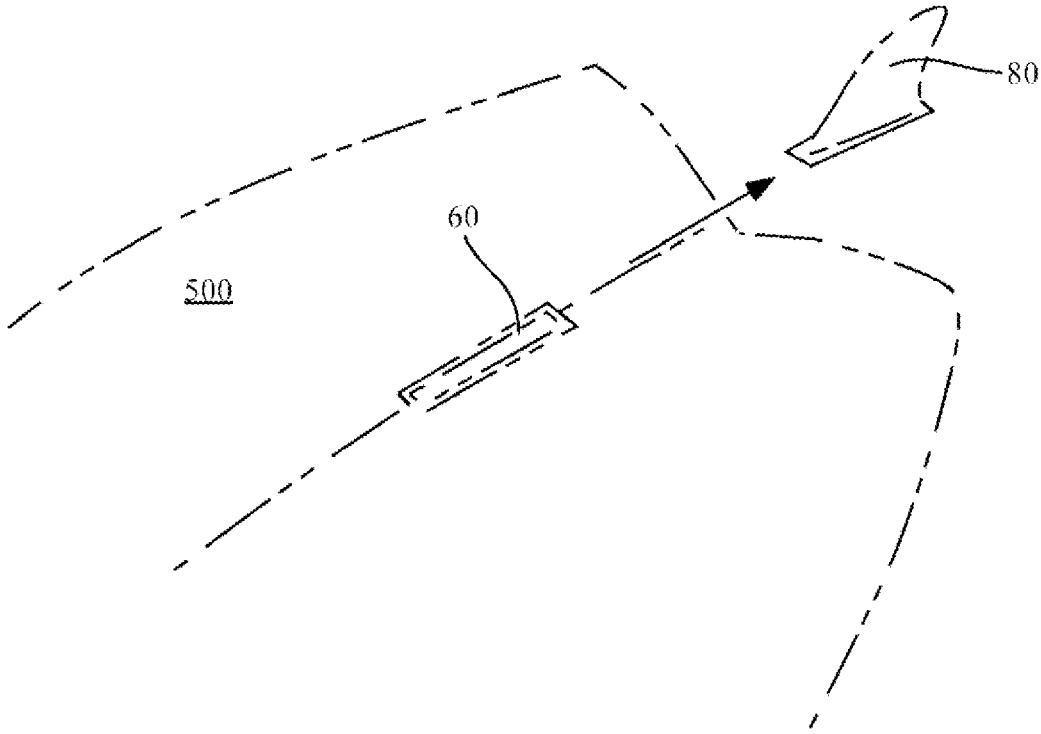
FIG. 5—depicts an exemplary perspective view of the installation of an embodiment of the locking device in a watersports apparatus.
Figure 5A:
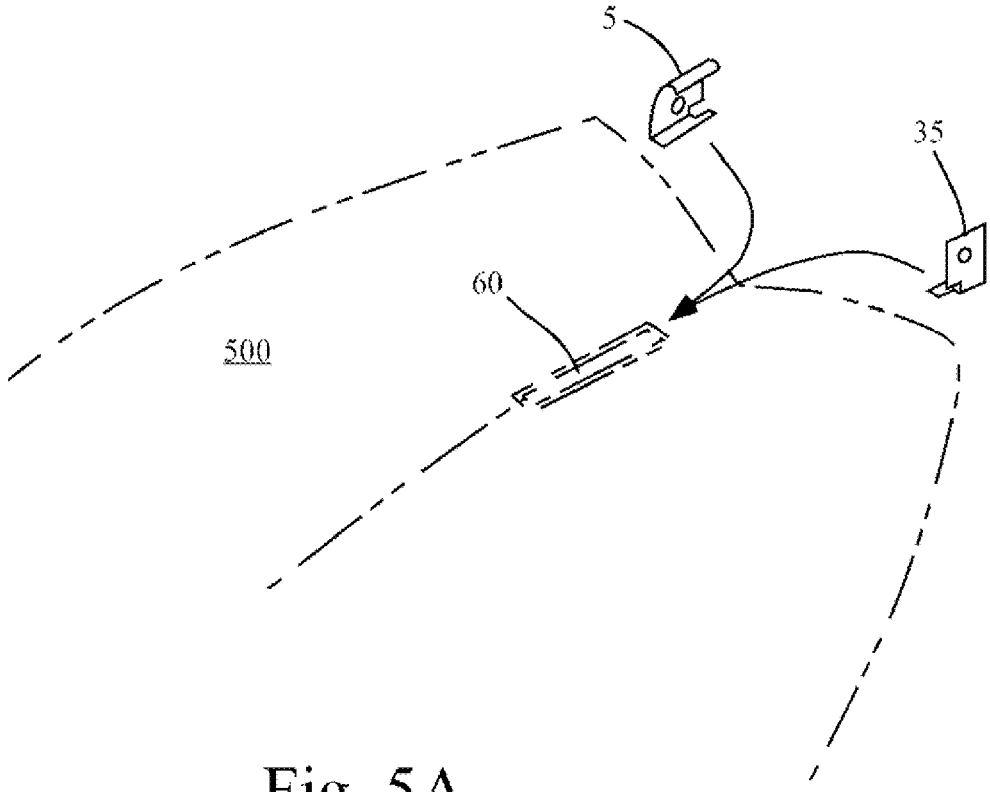
FIG. 5A—depicts another exemplary perspective view of the installation of an embodiment of the locking device in a watersports apparatus.
Figure 5B:
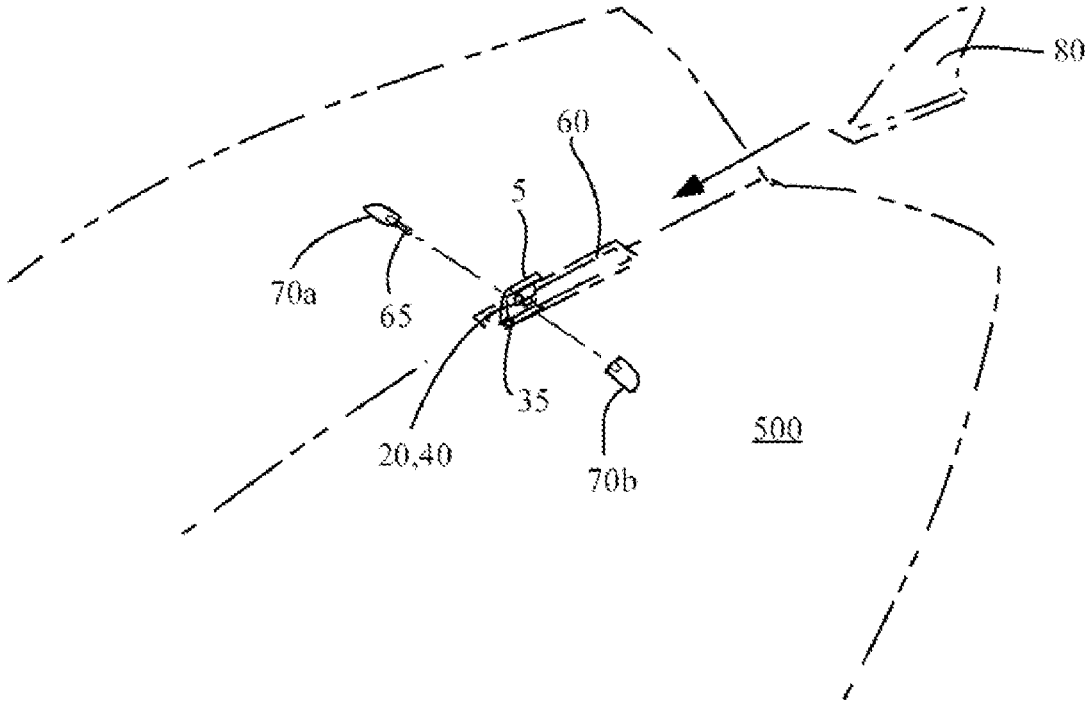
FIG. 5B—depicts another exemplary perspective view of the installation of an embodiment of the locking device in a watersports apparatus.
Figure 5C:
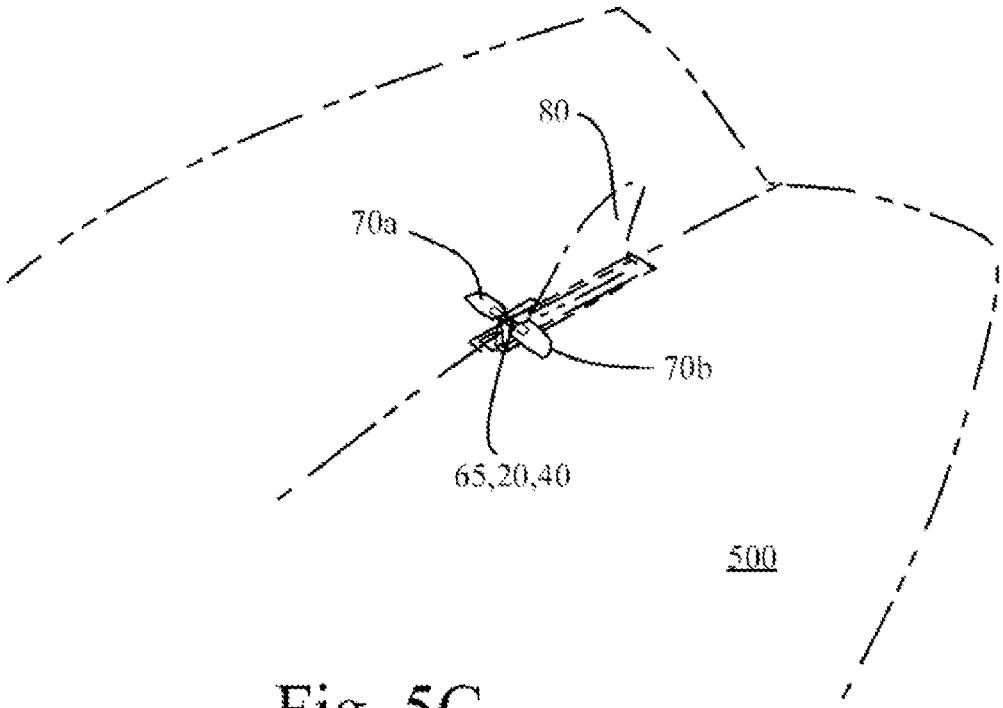
FIG. 5C—depicts another exemplary perspective view of the completed installation of an embodiment of the locking device in a watersports apparatus.

Referring to FIG. 5, installation of the locking device 5, 35 is depicted. In order to install the locking device, the fin 80 is removed from the fin box 60. The first and second brackets 5, 35, are then individually inserted (FIG. 5A) into the fin box 60 and interlocked to form the inverted "T" structure. The fin 80 is then reinstalled (FIG. 5B) into the fin box 60. If the watersports apparatus 500 is to be used, the keeper assembly 70A, 70B (FIG. 5C) is installed in the apertures 20, 40 to maintain the first and second brackets 5, 35 in place.

Figure 5D:
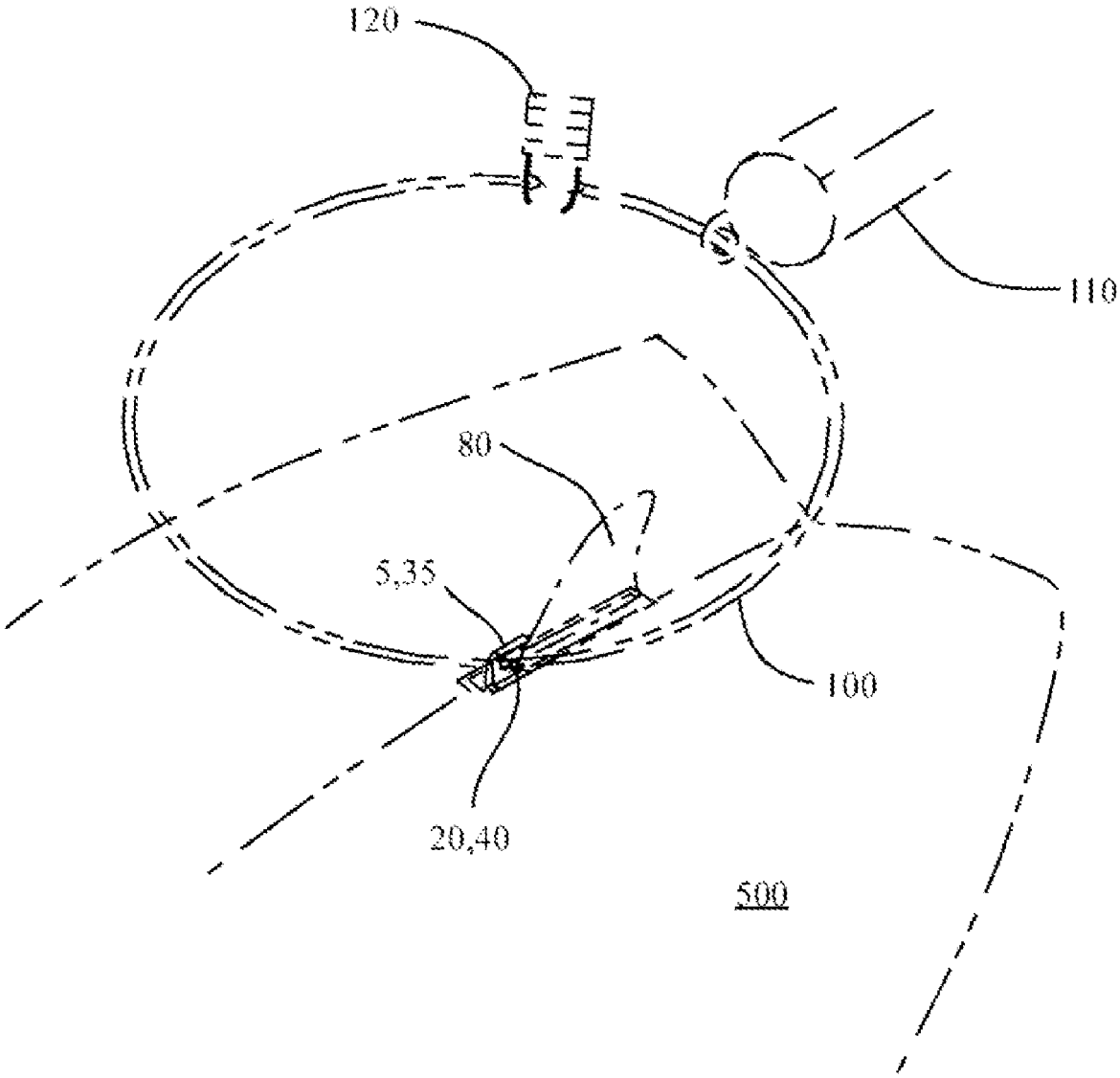
FIG. 5D—depicts another exemplary perspective view of the locking device securing the watersports apparatus to another structure.

Alternately, if the watersports apparatus 500 is to be secured, a cable 100 is inserted through the apertures 20, 40 of the first and second brackets 5, 35 and secured with a padlock 120 to a securing structure 110 (FIG. 5D.)

Figure 6:
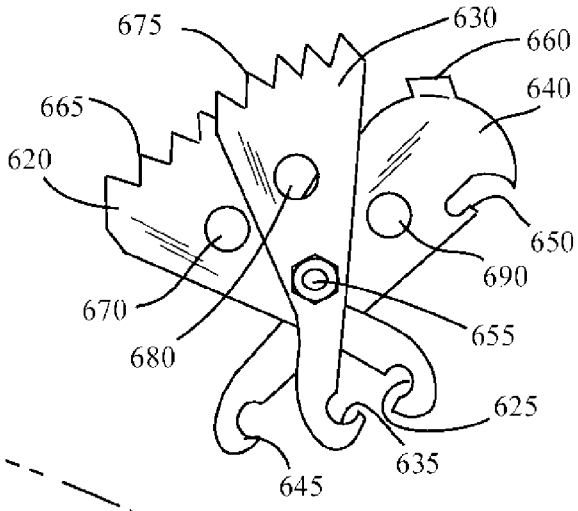
FIG. 6—depicts an exemplary front view of an alternate embodiment of the locking device for a watersports apparatus.
Figure 6A:
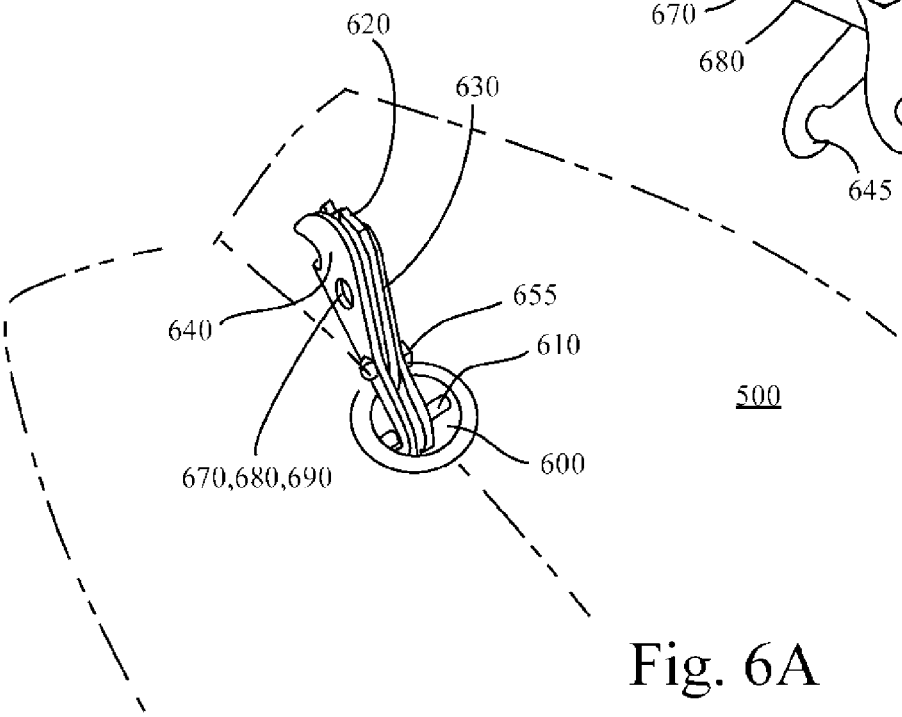
FIG. 6A—depicts an exemplary perspective view of the alternate embodiment of the locking device installed on a watersports apparatus.
Figure 6B:
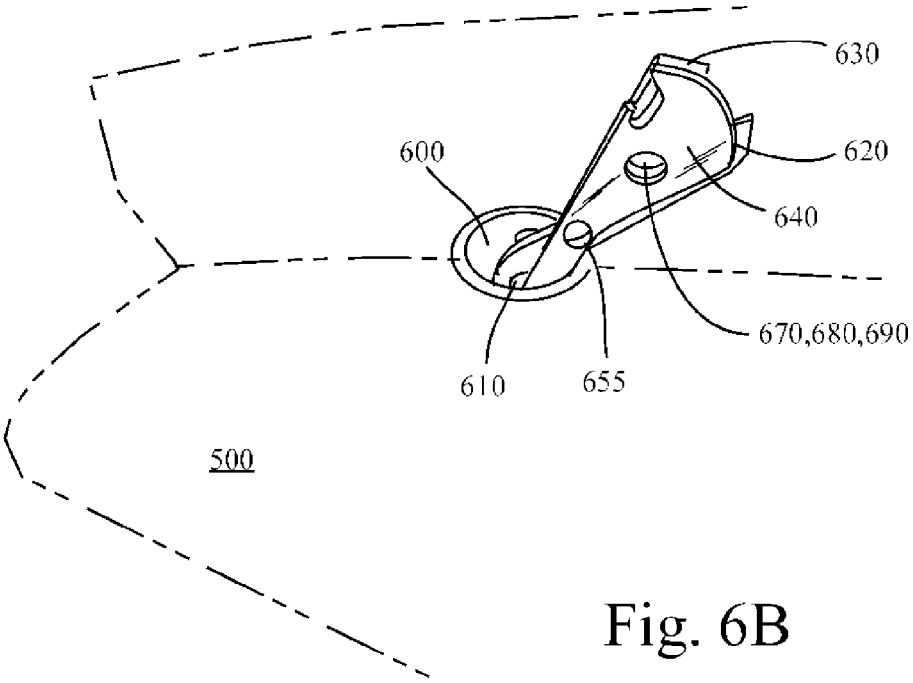
FIG. 6B—depicts another exemplary perspective view of the alternate embodiment of the locking device installed on a watersports apparatus.
Figure 6C:
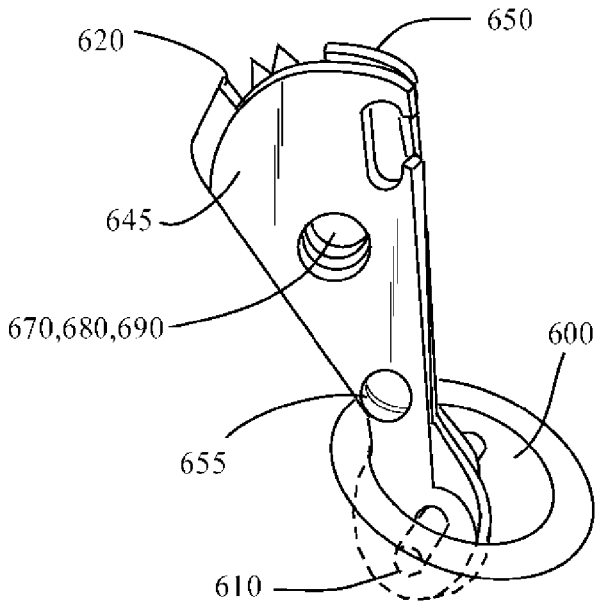
FIG. 6C—depicts an exemplary frontal cross sectional view of the alternate embodiment of the locking device installed on a watersports apparatus.

Referring to FIG. 6, an alternate embodiment of a palm sized locking device is provided. In an embodiment, a clasping mechanism is employed which takes advantage of certain structural elements included in a tether plug assembly 600 (FIGS. 6A, 6B) installed in the watersports apparatus 500. In an embodiment, two or three generally planar scissor members 620, 630, 640 are coupled together by a fastener 655. Each scissor member 620, 630, 640 includes an unguiform clasping member 625, 635, 645 for clasping a rod 610 installed in a tether plug 600 (FIG. 6C) of the watersports apparatus 500.

The unguiform clasping elements 625, 635, 645 are arranged in opposition relative to each other to clasp the rod 610 generally perpendicularly to its long axis. In various embodiments, tools 650, 660, 665, 675 useful with the watersports apparatus 500 are provided at the ends opposite the unguiform clasping elements 625, 635, 645. In various embodiments, the tools include one or more wax combs 665, 675, a screwdriver head 660 and a bottle cap opener 650. The wax combs 665, 675 may also be used as scrapping devices to remove excess wax from the watersports apparatus 500.

The scissor members 620, 630, 640 may be cut from corrosive resistant metal sheet stock such as stainless steel or injection molded from high impact plastic. The fastener 655 may utilize common fastening devices such as a rivet, nut and bolt, or pressed plug.

Figure 6D:
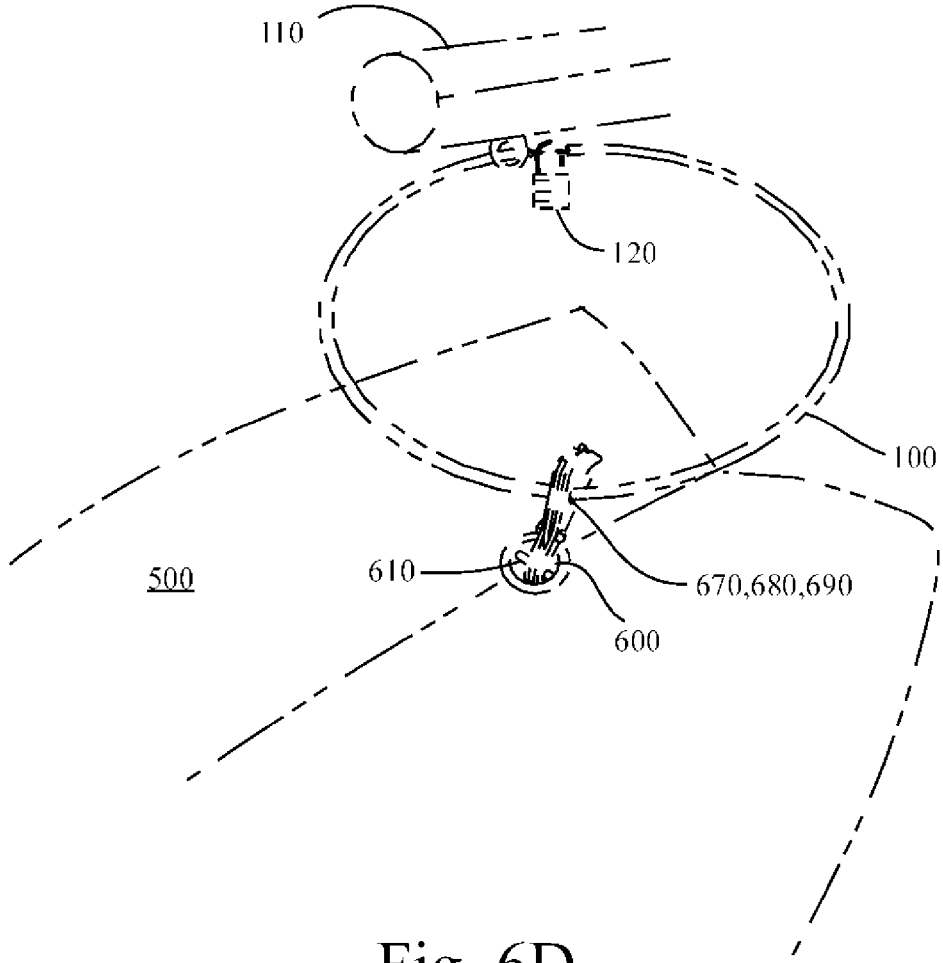
FIG. 6D—depicts an exemplary perspective view of the locking device securing the watersports apparatus to another structure.

Each scissor member includes an aperture 670, 680, 690 dimensioned to receive a cable 100 which is then secured with a padlock 120 to a securing structure 110 (FIG. 6D.) The apertures 670, 680, 690 become axially aligned when the scissor members 620, 630, 640 are disposed in a common longitudinal alignment.

The foregoing described embodiments of the invention are provided as illustrations and descriptions. They are not intended to limit the invention to precise form described. In particular, it is contemplated that various dimensions, colors and construction materials of the invention described herein may be implemented. No specific limitation is intended to a particular dimension, shape or construction material.

What is claimed:

1. A locking device for a watersports apparatus comprising:

a first generally planar element including;

a generally centralized first aperture therethrough;

a first anterior edge;

a first posterior edge;

a first base edge;

a lateral support element projecting perpendicularly from said first base edge;

a top edge including a generally downward facing channel element which parallels said lateral support element;

a first slot disposed superjacent and generally in parallel to said first base edge and extending a partial distance toward said first anterior edge;

a second generally planar element including;

a generally centralized second aperture therethrough;

a second anterior edge;

a second posterior edge;

a second base edge;

a contra-lateral support element projecting perpendicularly from said second base edge;

a top edge dimensioned to slidably fit within said channel element; and a second slot disposed superjacent and generally in parallel to said second base edge and dimensioned to intercalate with said first slot such that said first and second planar elements form an inverted "T" bracket; and, wherein said first and said second apertures are substantially aligned to provide a contiguous aperture through said inverted "T" bracket.

2. The device according to claim 1 wherein said first anterior edge includes a curved profile.

3. The device according to claim 1 wherein said first and said second generally planar elements are dimensioned to separately fit into a fin slot associated with a watersports apparatus and slidably combine into said inverted "T" bracket thereafter.

4. The device according to claim 1 wherein said contiguous aperture is dimensioned to receive at least a portion of a security device therethrough.

5. The device according to claim 4 wherein said security device includes one of a cable, a chain, a padlock, a combination lock and any combination thereof.

6. The device according to claim 3 wherein said inverted "T" bracket is maintained in said fin slot by a keeper device disposed in said contiguous aperture.

7. The device according to claim 6 wherein a keeper device is configured to prevent said first and second planar elements from separating during use of said watersports apparatus.

8. The device according to claim 6 wherein said keeper device comprises:

a first streamlined member having a threaded aperture; and, a second streamlined member having a bolt longitudinally aligned and compatible with said threaded aperture, said bolt being dimensioned to fit with said aperture.

* * * * *